United States Patent [19]

DeMinco et al.

[11] Patent Number: 4,703,738

[45] Date of Patent: Nov. 3, 1987

[54] PURGE FLOW CONTROL VALVE

[75] Inventors: Chris M. DeMinco, West Rush; Martin J. Field, Churchville; Debra E. Serth, Spencerport, all of N.Y.

[73] Assignee: General Motors Corporation, Detroit, Mich.

[21] Appl. No.: 879,016

[22] Filed: Jun. 26, 1986

[51] Int. Cl.[4] ..... F02D 19/00

[52] U.S. Cl. ..... 123/520; 123/574

[58] Field of Search ..... 123/518, 519, 520, 574

[56] References Cited

U.S. PATENT DOCUMENTS

| | | | |
|---|---|---|---|
| 2,489,230 | 11/1949 | Winkler | 123/574 |
| 3,359,960 | 12/1967 | Pittsley | 123/574 |
| 3,518,977 | 7/1970 | Smith | 123/520 |
| 3,752,134 | 8/1973 | Hollis | 123/520 |
| 3,778,024 | 12/1973 | Rogerson | 123/520 |
| 3,782,351 | 1/1974 | Rogerson | 123/520 |
| 4,169,432 | 10/1979 | White | 123/574 |
| 4,193,383 | 3/1980 | Rogers | 123/520 |
| 4,541,396 | 9/1985 | Sato | 123/520 |

*Primary Examiner*—Ronald B. Cox

*Attorney, Agent, or Firm*—C. K. Veenstra

[57] ABSTRACT

A valve obstructs flow of fuel vapor to an engine induction passage both when the engine is not operating and when the engine is operating with a closed throttle, and varies flow of fuel vapor to the induction passage when the engine is operating with an open throttle.

1 Claim, 1 Drawing Figure

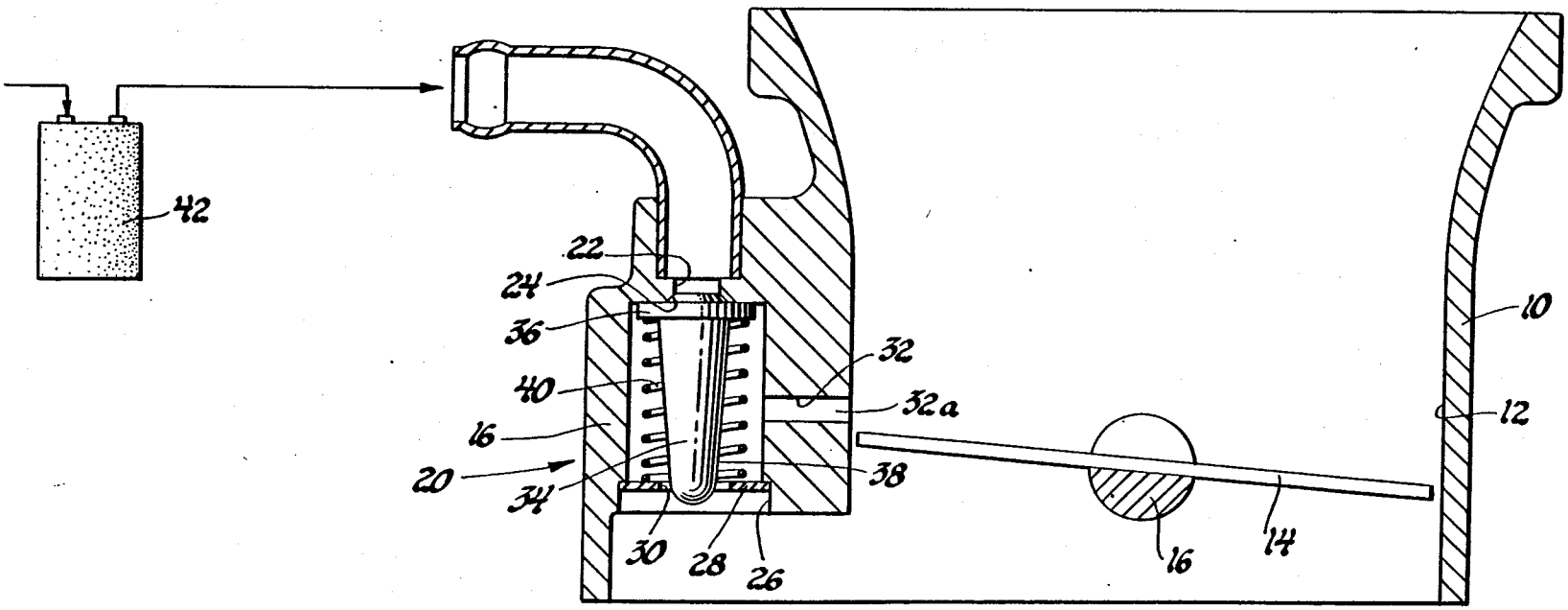
10
12
14
16
32
32a
38
26
28
30
22
24
36
40
46
34
20
42

PURGE FLOW CONTROL VALVE

TECHNICAL FIELD

This invention relates to purge of fuel vapor to an engine induction passage.

SUMMARY OF THE INVENTION

As the temperature in the fuel tank of an automotive vehicle rises, some of the fuel vapor in the space above the liquid fuel is displaced out of the tank into a fuel vapor storage canister. During subsequent operation of the vehicle, the fuel vapor is purged from the canister into the engine induction passage for combustion in the engine.

In some such systems, it is desired to obstruct the flow of fuel vapor from the canister to the induction passage both when the engine is not operating and when the engine is operating with the throttle closed to the idle position, and to vary the flow of fuel vapor from the canister to the induction passage when the engine is operating with the throttle opened beyond an idle position.

This invention provides a purge flow control valve that obstructs flow of fuel vapor to an engine induction passage both when the engine is not operating and when the engine is operating with a closed throttle, and varies flow of fuel vapor to the induction passage when the engine is operating with an open throttle.

The details as well as other features and advantages of a preferred embodiment of this invention are set forth in the remainder of the specification and are shown in the drawing.

SUMMARY OF THE INVENTION

The sole figure of the drawing is a schematic view of a fuel vapor control system employing a preferred embodiment of the purge flow control valve provided by this invention.

THE PREFERRED EMBODIMENT

Referring to the drawing, an engine throttle body 10 defines an induction passage 12 for air flow to the engine. A throttle 14 is mounted on a shaft 16 in induction passage 12 and is rotatable with shaft 16 from the closed or idle position shown through part throttle positions to a wide open throttle position, thereby varying the area available for air flow through induction passage 12 and thus controlling air flow through induction passage 12 to the engine.

Throttle body 10 also forms a housing 18 of a purge flow control valve 20. Housing 18 has an inlet 22 for fuel vapor and a valve seat 24 surrounding inlet 22. Housing 18 also has a primary outlet 26 opening to induction passage 12 downstream of throttle 14. A plate 28 is disposed in outlet 26 and has an orifice 30 restricting flow through outlet 26. In addition, housing 18 has a secondary outlet 32 opening to induction passage 12 through a port **32*a* located upstream of throttle 14 when throttle 14 is in the closed position shown and downstream of throttle 14 when throttle 14** is opened from the closed position shown to a part throttle or wide open throttle position.

A valve member 34 is disposed in housing 18. Valve member 34 has a head 36 engageable with valve seat 24 to obstruct flow through inlet 22 to housing 18. Valve member 34 also has a metering profile 38 receivable in orifice 30 for varying the flow restriction of orifice 30.

A spring 40 biases valve member 34 to engage head 36 with valve seat 24 and thereby obstruct flow through inlet 22 to housing 18. However, valve member 34 is movable against the bias of spring 40 in response to the subatmospheric manifold pressure in induction passage 12 downstream of throttle 14 to disengage head 36 from valve seat 24 and to cause metering profile 38 to vary the flow restriction of orifice 30 in accordance with variations in the manifold pressure.

Inlet 22 is connected to receive fuel vapor from a fuel vapor storage canister 42. When the engine is not operating and the manifold pressure rises to atmospheric pressure, spring 40 engages valve head 36 with valve seat 24 to obstruct migration of fuel vapor from canister 42 through induction passage 12 to the atmosphere.

When the engine is operating with throttle 14 closed to the position shown, the manifold pressure drops and draws valve member 34 downwardly. Metering profile 38 then restricts or obstructs orifice 30 to minimize flow therethrough. Moreover, flow through port **32*a* is minimized because port 32*a* is then exposed to the generally atmospheric pressure in induction passage 12 upstream of throttle 14**.

When the engine is operating with throttle 14 opened to a part throttle position, port **32*a* is exposed to the subatmospheric manifold pressure in induction passage 12 downstream of throttle 14, and fuel vapor is purged from canister 42 through inlet 22, housing 18 and outlet 32 to port 32*a* in induction passage 12 for delivery to the engine. Moreover, the manifold pressure increases as the throttle is opened (or as the engine load increases), and spring 40 lifts valve member 34 to partially withdraw metering profile 38 from orifice 30. The increased flow area of orifice 30 then allows the manifold pressure to purge fuel vapor from canister 42 through inlet 22, housing 18 and orifice 30 to outlet 26 for delivery to the engine. Metering profile 38** may be contoured to achieve the desired purge flow.

As throttle 14 is opened further, and as the engine load increases, the manifold pressure continues to rise. When the manifold pressure approaches the atmospheric pressure, spring 40 engages valve head 36 with valve seat 24 to again obstruct flow of fuel vapor through inlet 22.

It will be appreciated that inlet 22 could be connected to the engine crankcase and that this purge flow control valve then could be employed to control purge of fuel vapor from the crankcase to the engine induction passage.

We claim:

1. A valve for controlling purge of fuel vapor to an engine having an induction passage for air flow to the engine and a throttle in said induction passage rotatable between closed and open positions for controlling air flow therethrough, said valve comprising a housing having an inlet for fuel vapor, a valve seat surrounding said inlet, a primary outlet to said induction passage downstream of said throttle, an orifice restricting flow through said primary outlet, a secondary outlet to said induction passage at a location upstream of said throttle when said throttle is in said closed position and downstream of said throttle when said throttle is in said open position, a valve member in said housing, said valve member having a head engageable with said valve seat to obstruct flow through said housing, said valve member further having a metering section receivable in said orifice for varying the flow restriction of said orifice, and a spring biasing said valve member to engage said head with said valve seat, said valve member being movable against the bias of said spring in response to the subatmospheric pressure in said induction passage downstream of said throttle to disengage said head from said valve seat and to cause said metering section to vary the flow restriction of said orifice in accordance with variations in said pressure, whereby flow of fuel vapor through said inlet to said induction passage is obstructed when the engine is not operating, flow of fuel vapor through said inlet to said induction passage is limited to said primary outlet when the engine is operating and said throttle is in said closed position, and flow of fuel vapor through said inlet to said induction passage is permitted through both said primary outlet and said secondary outlet when the engine is operating and said throttle is not in said closed position.

* * * * *